US006370695B2

(12) United States Patent
Paris et al.

(10) Patent No.: US 6,370,695 B2
(45) Date of Patent: Apr. 16, 2002

(54) HEAD GEAR APPARATUS

(75) Inventors: Carmen J. Paris; Jose F. Guzman; Jack F. Long, all of Warsaw; Christian H. Clupper, Columbia City; Stacy A. Trick, Manchester, all of IN (US)

(73) Assignee: DePuy Orthopaedics, Inc., Warsaw, IN (US)

( * ) Notice: Subject to any disclaimer, the term of this patent is extended or adjusted under 35 U.S.C. 154(b) by 0 days.

(21) Appl. No.: 09/897,655

(22) Filed: Jun. 29, 2001

Related U.S. Application Data

(63) Continuation of application No. 09/581,904, filed as application No. PCT/US99/00928 on Jan. 15, 1999.
(60) Provisional application No. 60/071,753, filed on Jan. 16, 1998.

(51) Int. Cl.[7] ..... A42C 5/04
(52) U.S. Cl. ..... 2/171.3; 2/84; 2/202; 2/424
(58) Field of Search ..... 2/171.3, 424, 422, 2/7, 84, 202, 410, 906; 128/201.25

(56) References Cited

U.S. PATENT DOCUMENTS

| | | | | |
|---|---|---|---|---|
| 195,865 | A | | 10/1877 | Wilson |
| 1,445,176 | A | | 2/1923 | Schmelzer |
| 1,467,227 | A | | 9/1923 | Capell |
| 1,715,071 | A | | 5/1929 | Martens et al. |
| 1,818,607 | A | | 8/1931 | Campbell |
| 1,825,114 | A | | 9/1931 | Hendrickson |
| 1,867,809 | A | | 7/1932 | Chase |
| 2,011,298 | A | | 8/1935 | Osbun et al. |
| 2,350,939 | A | | 6/1944 | Sprouse |
| 2,361,676 | A | | 10/1944 | Baker |
| 2,660,401 | A | | 11/1953 | Hull, Jr. |
| 2,772,538 | A | | 12/1956 | Ullery |
| 3,140,042 | A | | 7/1964 | Fujii |
| 3,368,744 | A | | 2/1968 | Jenn |
| 3,444,817 | A | | 5/1969 | Caldwell |
| 3,491,374 | A | | 1/1970 | Frangos |
| 3,822,698 | A | | 7/1974 | Guy |
| 3,963,021 | A | | 6/1976 | Bancroft |
| 4,136,688 | A | | 1/1979 | Gorman |
| 4,174,924 | A | | 11/1979 | Smithson, Jr. |
| 4,227,520 | A | | 10/1980 | Lord |
| 4,280,491 | A | | 7/1981 | Berg et al. |
| 4,364,712 | A | | 12/1982 | Charles |
| 4,455,687 | A | | 6/1984 | Johansson |
| 4,462,399 | A | | 7/1984 | Braun |
| 4,531,890 | A | | 7/1985 | Stokes |
| 4,549,103 | A | | 10/1985 | Shiga |
| 4,664,593 | A | | 5/1987 | Hayashi et al. |
| 4,672,968 | A | * | 6/1987 | Lenox et al. |
| 4,730,612 | A | | 3/1988 | Dampney |
| 4,744,106 | A | * | 5/1988 | Wang |
| 4,752,974 | A | | 6/1988 | Haino |
| D298,473 | S | | 11/1988 | Stackhouse et al. |
| 4,810,269 | A | | 3/1989 | Stackhouse et al. |
| 4,826,513 | A | | 5/1989 | Stackhouse et al. |
| D303,166 | S | | 8/1989 | Stackhouse et al. |

(List continued on next page.)

FOREIGN PATENT DOCUMENTS

| | | |
|---|---|---|
| DE | 27 44 488 | 4/1978 |
| FR | 1017797 | 12/1952 |
| SU | 986429 | 1/1983 |
| SU | 1068130 | 1/1984 |
| WO | WO 94/03235 | 2/1994 |

*Primary Examiner*—Rodney M. Lindsey
(74) *Attorney, Agent, or Firm*—Maginot, Moore & Bowman

(57) ABSTRACT

A head gear apparatus (10) is provided that moves air to cool a caregiver's head. The head gear apparatus (10) includes a helmet (12) that has a shell (114) configured to rest upon a head of a user and a fan housing (120) movably coupled to shell (114), a fan (122) is positioned to lie within fan housing (120) and moves with fan housing (120) relative to shell (114), and a garment (14) selectively coupled to helmet (12). Garment (14) includes a face shield (20).

14 Claims, 7 Drawing Sheets

U.S. PATENT DOCUMENTS

| | | | | |
|---|---|---|---|---|
| D304,612 | S | | 11/1989 | Stackhouse et al. |
| D304,854 | S | | 11/1989 | Stackhouse et al. |
| D306,363 | S | | 2/1990 | Stackhouse et al. |
| 4,901,716 | A | | 2/1990 | Stackhouse et al. |
| 4,915,588 | A | | 4/1990 | Brackett |
| 4,986,282 | A | | 1/1991 | Stackhouse et al. |
| 4,999,846 | A | | 3/1991 | Ball et al. |
| 5,042,474 | A | | 8/1991 | Williamson |
| 5,046,492 | A | | 9/1991 | Stackhouse et al. |
| 5,054,479 | A | * | 10/1991 | Yelland et al. |
| 5,054,480 | A | | 10/1991 | Bare et al. |
| 5,125,402 | A | | 6/1992 | Greenough |
| 5,140,980 | A | | 8/1992 | Haughley et al. |
| 5,226,939 | A | | 7/1993 | Nicolas et al. |
| 5,253,642 | A | | 10/1993 | Stackhouse et al. |
| 5,283,914 | A | | 2/1994 | James |
| 5,354,178 | A | | 10/1994 | Ferleger et al. |
| 5,380,245 | A | | 1/1995 | Reiterman et al. |
| 5,456,248 | A | | 10/1995 | Holian et al. |
| 5,520,668 | A | | 5/1996 | Greff et al. |
| 5,578,000 | A | | 11/1996 | Greff et al. |
| 5,588,153 | A | | 12/1996 | Ignon et al. |
| 5,592,936 | A | | 1/1997 | Thomas, Jr. et al. |
| 5,620,441 | A | | 4/1997 | Greff et al. |
| 5,624,234 | A | | 4/1997 | Neely et al. |
| 5,711,033 | A | * | 1/1998 | Green et al. |
| 5,961,289 | A | | 10/1999 | Lohmann |
| 5,964,576 | A | | 10/1999 | Fujita et al. |
| 5,984,638 | A | | 11/1999 | Gresh et al. |

* cited by examiner

HEAD GEAR APPARATUS

This application is a continuation of application Ser. No. 09/581,904 filed on Jun. 16, 2000 which is based pursuant to 35 U.S.C. § 371 on PCT International Application No. PCT/US99/00928 filed on Jan. 15, 1999, which in turn claims the benefit of U.S. Provisional Application Ser. No. 60/071,753 filed on Jan. 16, 1998.

BACKGROUND AND SUMMARY OF THE INVENTION

The present invention is directed to a head gear apparatus that moves air to cool a caregiver's head, more particularly to a head gear apparatus that provides the caregiver with a fresh air stream while protecting the caregiver from splashing fluids and other materials during surgery. Still more particularly, the present invention is directed to a head gear apparatus that includes a helmet, a fan, and a surgical garment.

It is known to provide helmets with a fan. See for example U.S. Pat. Nos. 5,125,402 to Greenough; 4,136,688 to Gorman; 5,592,936 to Thomas, Jr. et al.; and 5,054,480 to Bare et al. These conventional helmets, however, carry fans that are positioned to lie in a pre-determined position. This position can be uncomfortable for the wearer of the helmet.

It is also known to provide surgical gowns with a pre-determined lengths. See for example U.S. Pat. Nos. 5,142,704 to Viemeister et al. and 5,253,642 to Stackhouse et al.

According to the present invention a head gear apparatus is provided. The apparatus comprises a helmet including a shell configured to rest upon a head of a user and a fan housing movably coupled to the shell, a fan positioned to lie within the fan housing, and a garment. The garment is selectively coupled to the helmet and includes a face shield.

In preferred embodiments, the shell includes a front end, a back end, and an aperture extending between the front and back ends. The fan housing includes guides that extend through the aperture and are movable between the front and back ends to move the fan on the shell. The aperture in the shell is defined by at least one guide track, and the fan housing includes a floor portion with at least one boss that rides along the at least one guide track. Additionally, the helmet further includes a shield that couples to an inner surface of the shell adjacent to the aperture.

Still further, the helmet includes an inner panel spaced-apart from the inner surface of the shell to define a passageway that extends between the inner panel and the inner surface of the shell. Particularly, the passageway extends between the fan housing and the front end of the shell. An air duct is also coupled to the fan housing and defines a channel. The air duct is movable with the fan housing on the shell and moves in the passageway to route an air stream toward a user's fiche. In addition, the helmet shield mount is positioned to lie adjacent to the front end of the shell that is formed for attachment with the garment.

In another embodiment of the present invention, a head gear apparatus is provided that comprises a helmet that includes a shell configured to rest upon a head of a user and formed to include a front end and a back end, a fan housing coupled to the shell, a fan positioned to lie within the fan housing, and a garment selectively coupled to the helmet.

In yet another embodiment of the present invention, a head gear apparatus is provided that comprises a helmet and a garment selectively coupled to the helmet. The garment includes a head portion having a face shield, a front side, and an opposite back side. The front side has a top edge and a bottom edge defining a first normal pre-determined length and a middle portion extending between the top and bottom edges. The back side has a second normal pre-determined length that is less than the normal pre-determined length of the front side. The bottom edge of the front side is folded upon the middle portion and affixed in a folded position so that the front side has a folded length that is generally equal to the second normal pre-determined length of the back side.

Additional features and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1:
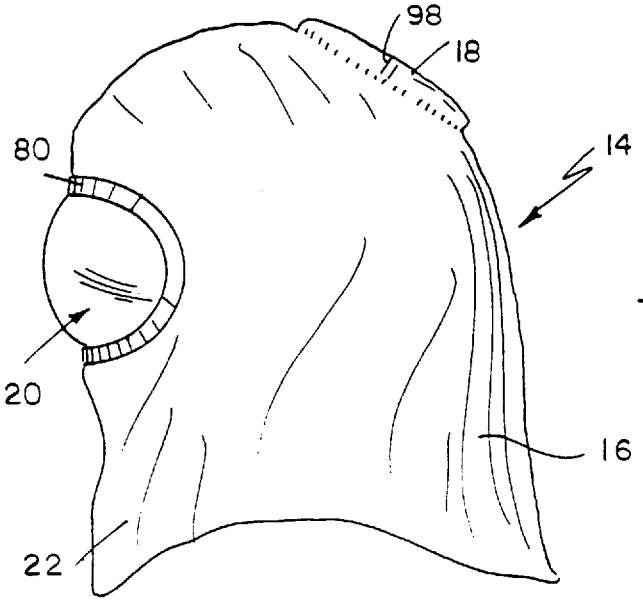
FIG. 1 is a side view of a head portion of a surgical garment in accordance with the present invention showing the head portion including a fabric garment portion, filter media coupled to the garment portion, and a face shield.
Figure 2:
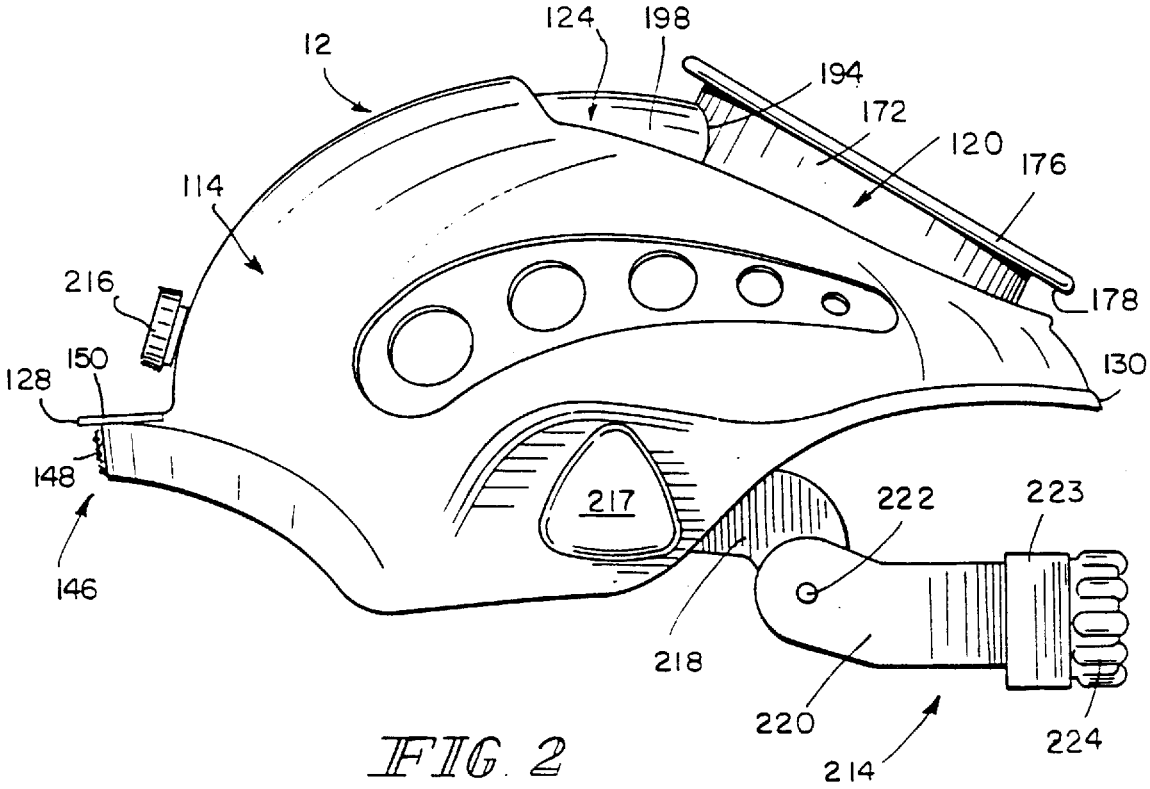
FIG. 2 is a side view of a helmet in accordance with the present invention that is suitable for use with the surgical garment of FIG. 1 showing the helmet including a shell having a front end and a back end, a fan housing adjacent to the back end an air duct extending from the fan housing, and a strap coupled to the shell with a fixation tab.
Figure 7:
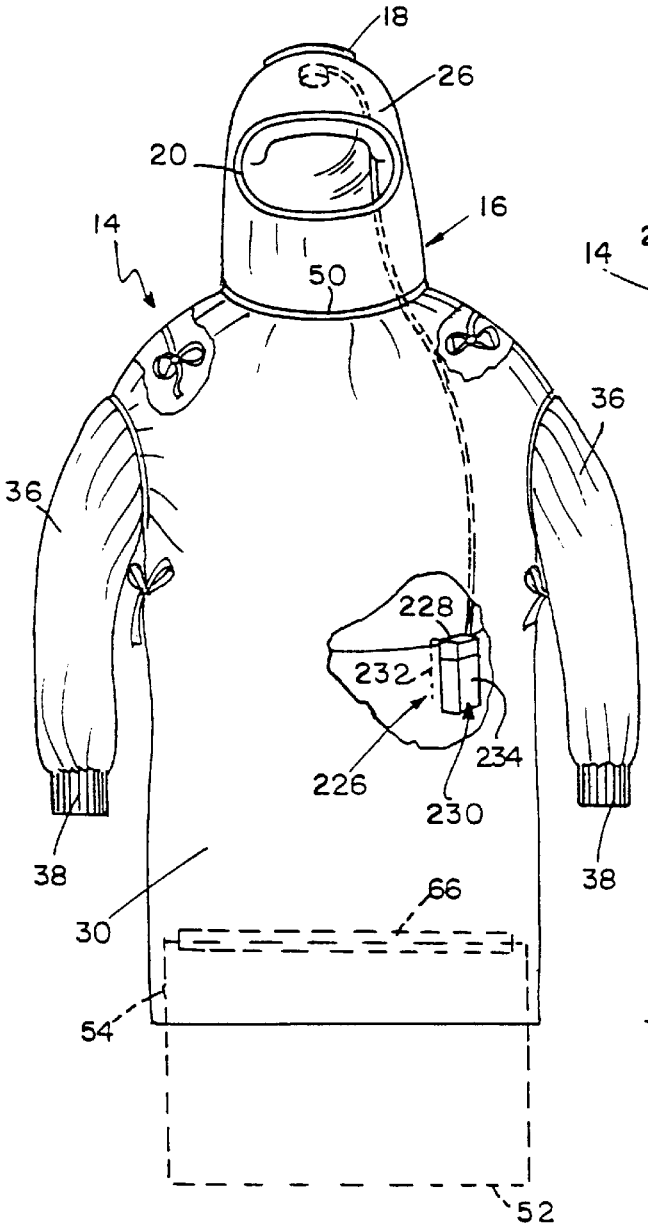
FIG. 7 is a front view with portions broken away of the head gear apparatus of FIG. 5 showing the fan in phantom and the garment having the head portion, a front side, arm portions extending from the front side, waist ties positioned to lie adjacent the arm portions, shoulder ties, a battery coupled to the fan and an adapter holding the battery and clipped to a user's waistband, and also showing in phantom, an adhesive strip and a bottom edge of the front side extended to a normal length.

As shown in FIGS. 1, 2, and 7, a surgical garment 14 and a helmet 12 are provided in accordance with the present invention to form headgear apparatus 10. Helmet 12 cooperates with garment 14 to provide a user with a fresh air stream while protecting the user from splashing fluids and materials during surgery. In addition, helmet 12 and garment 14 also cooperate to help protect the patient from contamination during the surgical procedure.

FIG. 1 illustrates garment 14 of headgear apparatus 10. Garment 14 includes a fabric portion 16, filter media 18 coupled to fabric portion 16, and a face shield 20. Fabric portion 16 includes an outer surface 22 and an opposite inner surface 24. Illustratively, fabric portion 16 is constructed of a conventional woven polyester fabric that is generally resistant to the passage of contaminated fluids and aerosols. It is appreciated, however, that garment portion may be constructed from a non-woven fabric or any one of a wide variety of natural or synthetic fibers in accordance with the present disclosure.

Figure 3:
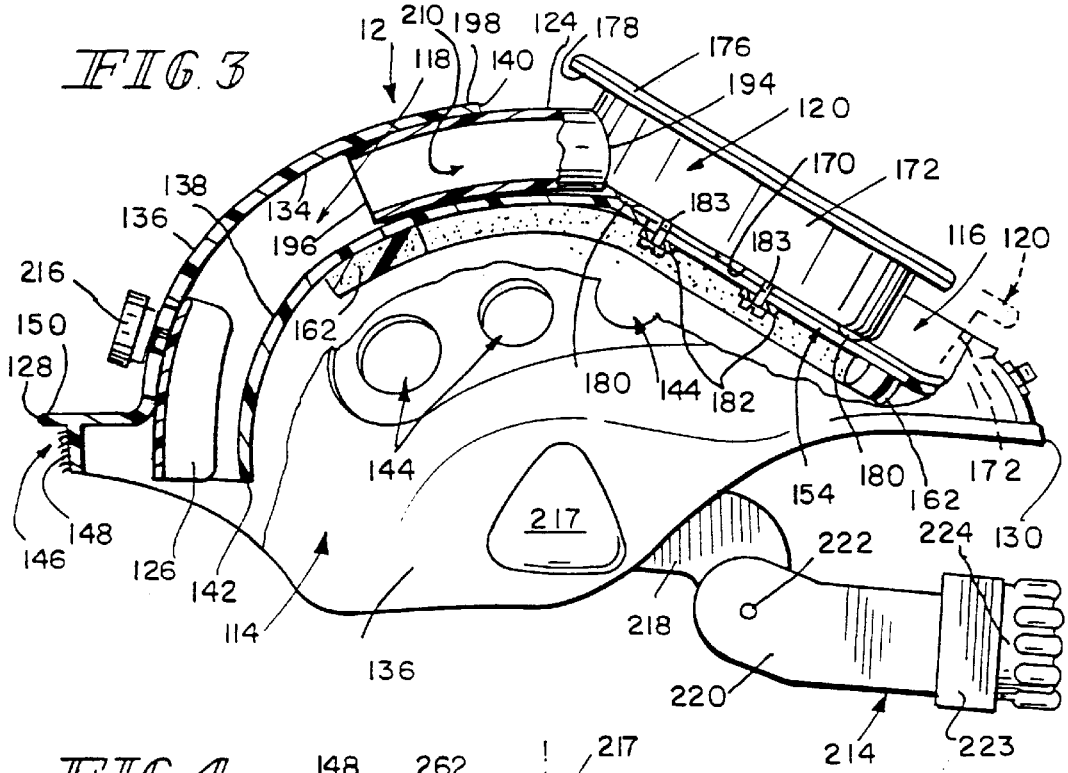
FIG. 3 is a side view of the helmet of FIG. 2 with portions broken away showing the shell formed to include a fan-receiving cavity adjacent to the back end and a passageway extending between the fan-receiving cavity and the front end of the shell, an air flow deflector positioned to lie within the passageway, and the fan housing positioned within the fan-receiving cavity for movement relative to the back end of the shell.
Figure 4:
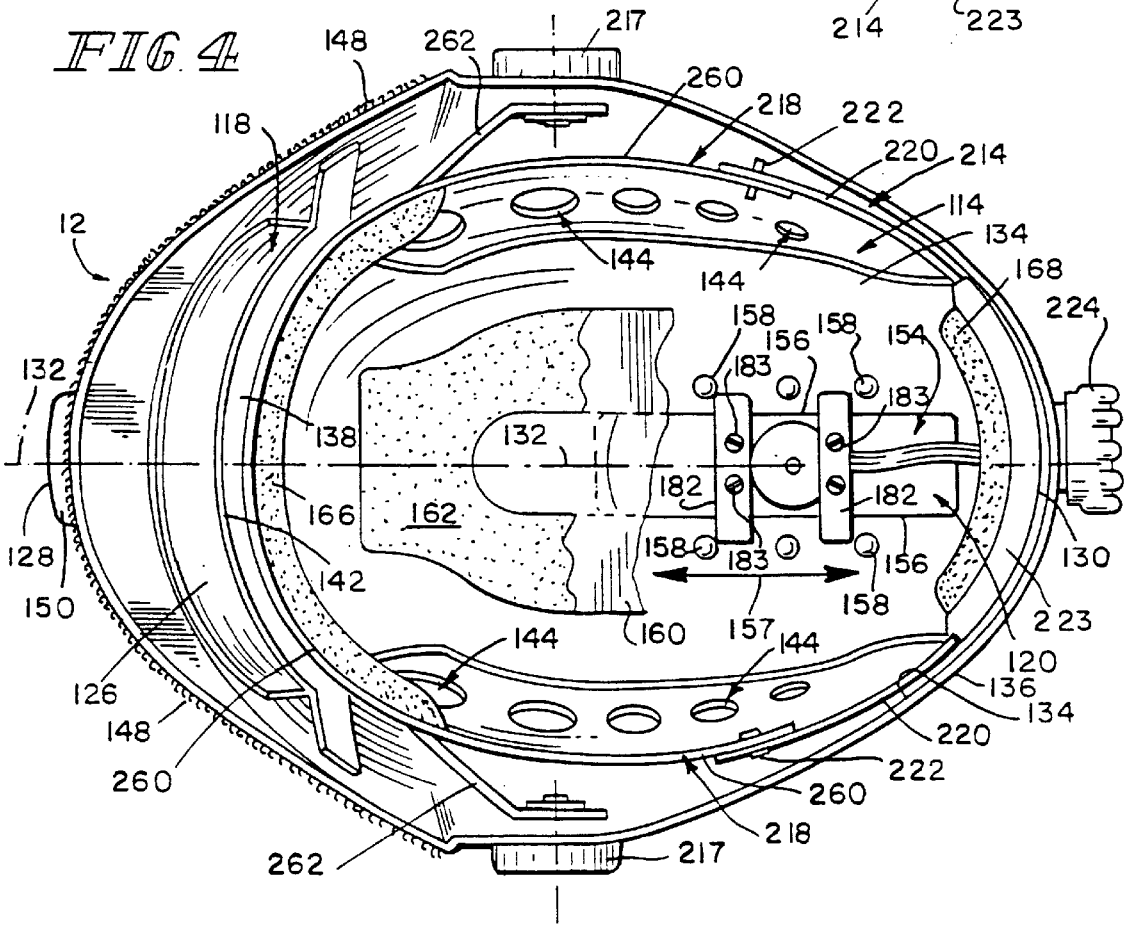
FIG. 4 is a bottom view of the helmet of FIG. 2 showing the helmet including an inner surface having a plurality of openings therethrough, a guide track aperture extending therethrough, and a head shield that is affixed to the inner surface to cover the guide track aperture.

Referring now to FIGS. 2–4, helmet 12 in accordance with the present invention is configured for use with garment 14. Helmet 12 includes a shell 114 defining a fan-receiving cavity 116, a movable fan housing 120 positioned to lie within cavity 116, an air duct or front snout 124 extending from fan housing 120, and an air flow deflector 126. Shell 114 includes a front end 128, an opposite back end 130, and a centerline 132 extending between front and back ends 128, 130. In addition, shell 114 includes an inner surface 134 configured to face a user's head 28, an opposite outer surface 136, and venting apertures 144 extending between outer and inner surfaces 136, 134. As best shown in FIG. 3, an inner panel 138 is spaced apart from inner surface 134 of shell 114 and defines a passageway 118 therebetween. Passageway 118 has an entrance 140 and an opposite exit 142 adjacent to front end 128 of shell 114.

As shown in FIG. 2, shell 114 of helmet 12 further includes a shield mount 146 adjacent to front end 128. Shield mount 146 includes hook-and-loop type fasteners 148 coupled to helmet 12 and a location flange 150 that is configured to mate with face shield 20 of garment 14. It is appreciated that a mechanical lock and any number of attachment devices may be used in accordance with the present disclosure to couple face shield 20 and helmet 12 together. Location flange 150 is a mechanical stop for corresponding face shield 20 and provides a true position shield orientation for the user when donning garment 14.

As best shown in FIG. 4, shell 114 also includes a guide-track aperture 154 adjacent to cavity 116. Aperture 154 is defined by opposing guide tracks 156 that include several embossed circular detents 158 along their length. Each guide track 156 extends generally from back end 130 toward front end 128 of shell 114 to guide movement as shown by arrow 157 of fan housing 120 along centerline 132. It is appreciated that the spacing and intervals of detents 158 may vary without exceeding the scope of the present disclosure.

In addition, helmet 12 includes a head shield 160 to block entrance of the user's head 28 or hair into guide-track aperture 154. Head shield 160 is coupled to shell 114 with hook-and-loop type fasteners (not shown), although it is appreciated that a wide variety of fasteners may be used in accordance with the present disclosure. A headrest pad 162 is coupled to head shield 160 and is configured to extend along guide tracks 156. Pad 162 is constructed of foam rubber, although it is appreciated that a wide variety of pads may be used in accordance with the present disclosure.

Referring now to FIG. 3, fan housing 120 of helmet 12 is positioned to lie within cavity 116. Fan housing 120 articulates on embossed guide tracks 156 along centerline 132 of helmet 12. Fan housing 120 has a range of motion of about 30 degrees. Thus, the user is free to adjust the center of balance of helmet 12 by redistributing the weight of fan housing 120. It is appreciated, however, that the range of motion of fan housing 120 may be greater or less than about 30 degrees in accordance with the present disclosure. Fan housing 120 includes a floor portion 170 positioned to lie adjacent to shell 114, a side wall 172 extending from floor portion 170 to define an opening 174 therein, and a cover 176 is configured to be selectively coupled to side wall 172.

Fan housing 120 also has circular bosses 180 that extend from floor portion 170 and ride along guide tracks 156. Bosses 180 mate with the circular embossed detents 158 to provide an easy manner of fan housing 120 position selection. As best shown in FIG. 4, guides 182 are coupled to fan housing 120 and extend through aperture 154. Guides 182 are coupled to fan housing 120 by screws 183. Guides 182 may be removed from fan housing 120 to permit fan housing 120 to be removed from helmet 12. It is appreciated that bosses 180 and guides 182 may be formed in a variety of shapes and may be coupled to fan housing 120 using a wide variety of fasteners such as, for example, pins, rivets, staples, etc., in accordance with the present disclosure.

Figure 5:
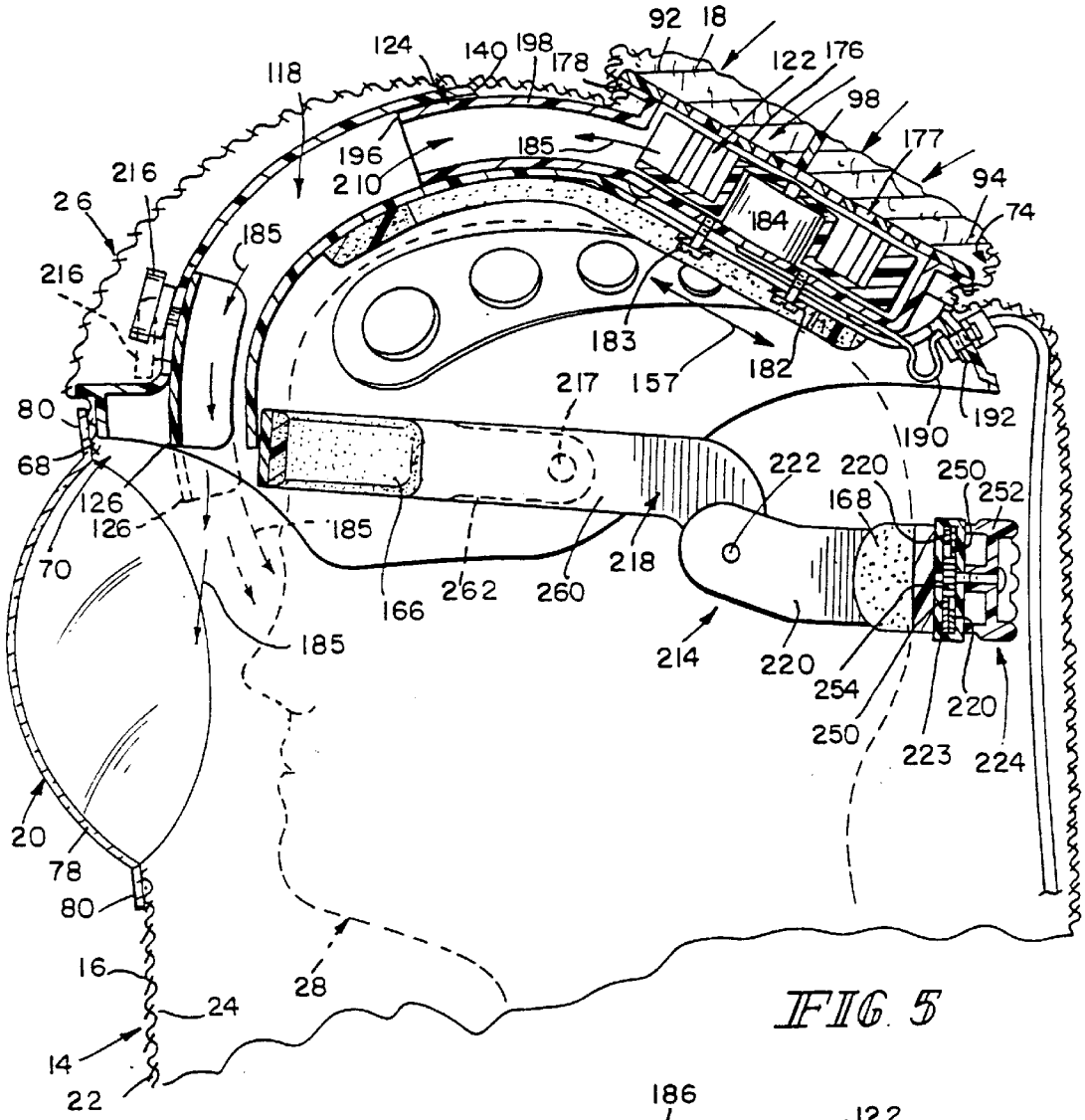
FIG. 5 is a side view with portions broken away of the helmet of FIG. 2 coupled to the head portion of surgical garment of FIG. 1 showing the helmet situated upon the head of a user and a fan positioned to lie in the fan housing of the helmet, and showing the flow path of air extending through the filter media where the fan directs the air flow into the passageway towards a face of the user.
Figure 11:
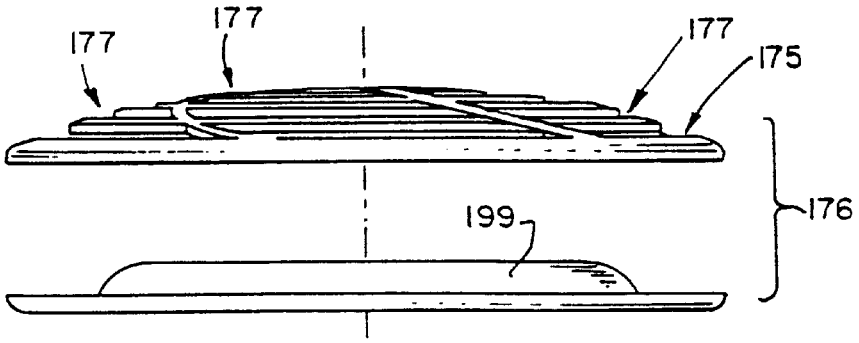
FIG. 11 is a side view of a cover of the fan housing showing the cover including a top portion having a plurality of apertures therethrough and an inlet ring.
Figure 12:
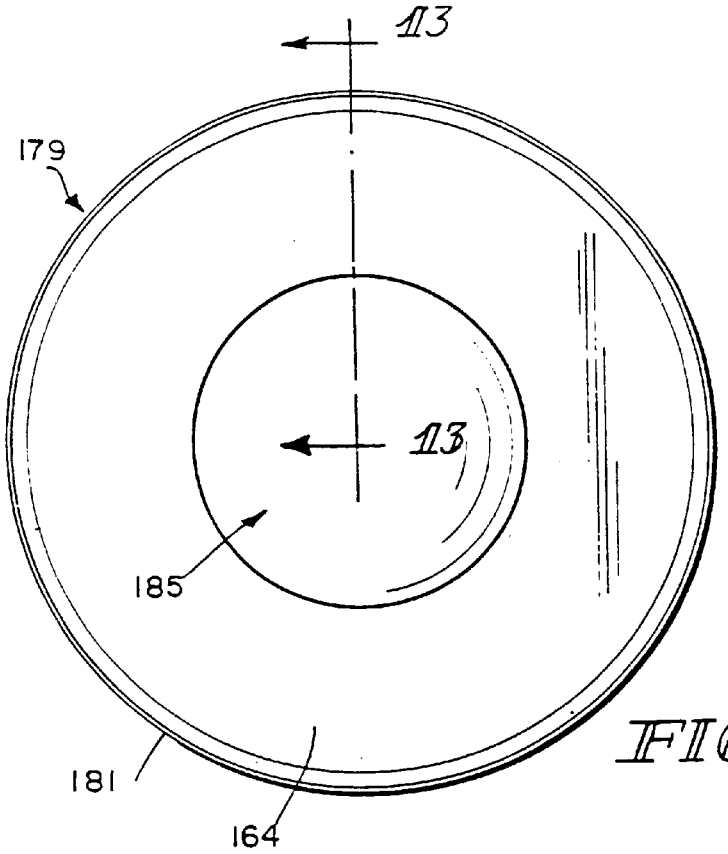
FIG. 12 is a top view of the inlet ring of FIG. 11 showing the inlet ring including an outer rim, a shield portion, and an aperture extending through the shield portion.
Figure 13:
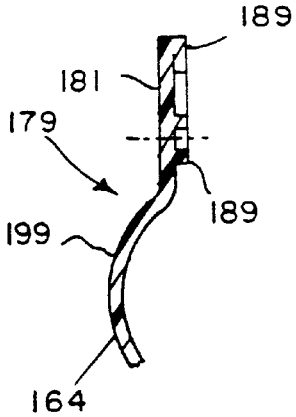
FIG. 13 is a view taken along line 13—13 of FIG. 12 showing the inlet ring including tabs for engaging the fan housing and showing the shield portion having a curved portion.

Referring to FIG. 5, cover 176 of fan housing 120 couples to filter media 18 to stabilize garment 14 on a user's head. Cover 176 is best shown in FIGS. 5 and 11. Cover 176 includes a top portion 175 formed to include a plurality of apertures 177 and an inlet ring 179 positioned to lie between top portion 175 and fan housing 120. Referring now to FIG. 11, inlet ring 179 includes an outer rim 181, a shield portion 164, and an aperture 185 extending through shield portion 164. Outer rim 181 of inlet ring 179, as shown in FIG. 13, includes tabs 189 that are configured for engagement with fan housing 120. In addition, shield portion 164 has a curved portion 199 configured for extension away from fan housing 120 toward top portion 175. Referring now to FIG. 5, inlet ring 179 and top portion 175 of cover 176 have a diameter that is greater than the diameter of side wall 172 to define a radially extending lip portion 178. Filter media 18 on garment 14 grips lip portion 178 of fan housing 120 when donned creating a seal therebetween. The cooperation between filter media 18 and fan housing 120 insures that generally only outside ambient air is pulled through filter media 18 into fan housing 120 toward the face of the user.

As shown in FIG. 5, air duct 124 of helmet 12 directs air flow as shown by arrows 185 toward the user's face. Air duct 124 works in conjunction with fan housing 120 to encompass the air flow. Air duct 124 extends from side wall 172 of fan housing 120 into passageway 118 of helmet 12 through entrance 140. As shown in FIG. 3, air duct 124 includes an outer end 194 coupled to fan housing 120, an inner end 196 positioned to lie within passageway 118, and a middle portion 198 extending between inner and outer ends 196, 194. Referring again to FIG. 5, air duct 124 defines a channel 210 configured to permit air flow as shown by arrows 185 therethrough. Movement of fan housing 120 within cavity 116 along centerline 132 as shown by arrow 157 causes movement of air duct 124 within passageway 118. Thus, as fan housing 120 is shifted toward passageway 118, inner end 196 of air duct 124 moves toward front end 128 of shell 114.

In addition, air flow deflector 126 of helmet 12 is positioned to lie adjacent exit 142 of passageway 118 at front end 128 of shell 114. Air flow deflector 126 changes or deflects air flow, as shown by arrow 185 in FIG. 5, to a comfortable location for the user. Air flow deflector 126 is coupled to a frontal fixation tab 216 that extends through front end 128 of shell 114. As shown in phantom in FIG. 5, frontal fixation tab 216 is movable relative to front end 128 and pulls air flow deflector 126 into and out of exit 142 of passageway 118.

Figure 6:
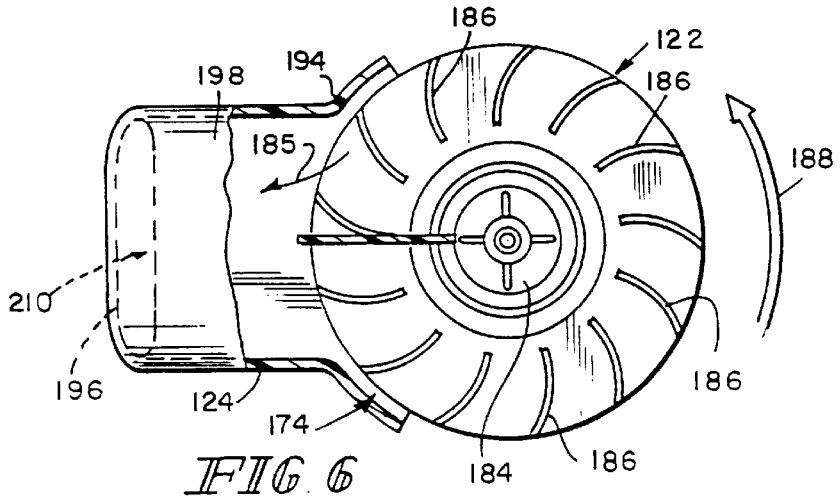
FIG. 6 is a top view of the fan of FIG. 5 showing the fan including curved blades and also showing the directional movement of the fan within the fan housing.

As shown in FIGS. 5 and 6, head gear apparatus 10 further includes a fan 122 that is positioned to lie within opening 174 of fan housing 120. Fan 122 includes a 12-volt motor 184 and blades 186 that are formed to have a reverse curvature in relation to the rotational direction as shown by arrow 188 of blades 186. It is believed that the reverse curvature of blades 186 improves the air flow within fan housing 120 by decreasing turbulent vortexes within opening 174 and generates air flow using small DC-motor 184. As best shown in FIG. 5, air is drawn into fan 122 through cover 176 and flows in a direction generally toward motor 184. Blades 186 rotating as indicated by arrow 188 causes the air to move in a direction radially outwardly from motor 186 into air duct 124. Although curved blades 186 are illustrated and described, it is appreciated that a variety of blades may be used in accordance with the present disclosure. In addition, various fans having a range of shapes and sizes of air inputs and air output as well as a range of air flow configurations may be used with apparatus 10. It is also appreciated that the voltage necessary to run motor 184 may vary in accordance with the present disclosure. As best shown in FIG. 5, a power cord 190 extends from motor 184 and is selectively coupled to a power connector 192. It is appreciated that power cord 190 may be removed from power connector 192 to permit fan 122 to be removed from helmet 12.

Referring now to FIGS. 2 and 4, a strap 214 is coupled to shell 114 with fixation tabs 217. Fixation tabs 217 secure strap 214 to helmet 12 and therefore increase the stability between strap 214 and helmet 12. As shown in FIG. 4, strap 214 includes first portions 218 coupled to fixation tab 217 and nape straps 220 coupled to first portions 218 by pivot pins 222. First portion 218 of strap 214 includes a U-shaped band 260 and mount tabs 262 extending from the band 260 and coupled to fixation tab 217. As shown in FIG. 4, a pad 166 is coupled to band 260 for engagement with a head 28 of a user.

Nape straps 220 include a notched aperture 250 and rotate about pivot points defined by pivot pins 222 spaced apart from notched aperture 250. Thus, nape straps 220 enable the user to select an optimal position (angle) of strap 214. Nape straps 220 extend into a strap cover 223 and cooperate with an adjustment knob 224 to tighten strap 214. As shown in FIG. 5, knob 224 includes a handle portion 252 and teeth 254 that extend through notched apertures 250 and engage nape straps 220. Turning handle portion 252 causes teeth 254 to engage notched portions in aperture 250 and thus move nape straps 220 relative to one another. Thus, knob 224 is configured to increase and decrease the overall length of nape straps 220 so that the user can adjust strap 214 to a specific size. A pad 168 is coupled to strap cover 223 for engagement with head 28. While strap 214 is illustrated and described, it is appreciated that a variety of straps may be coupled to shell 114 in accordance with the present disclosure.

As shown in FIGS. 5 and 7–9, garment 14 is coupled to helmet 12 to form headgear apparatus 10. Fabric portion 16 of garment 14 includes a head portion 26 configured to cover user's head 28 in phantom (FIG. 5), a front side 30 configured to lie adjacent a user's chest (not shown), an opposite back side 32 coupled to front side 30 at a seam 34, and arm portions 36 coupled to front and back sides 30, 32 adjacent to seam 34. It is appreciated, however, that garment 14 may be formed to include only head portion 26, as shown in FIG. 1, in accordance with the present disclosure. As best shown in FIG. 7, each arm portion 36 includes an elastic cuff 38 configured to engage a user's wrists (not shown) to hold arm portions 36 in a generally stationary position on the arms (not shown) of the user.

Figure 9:
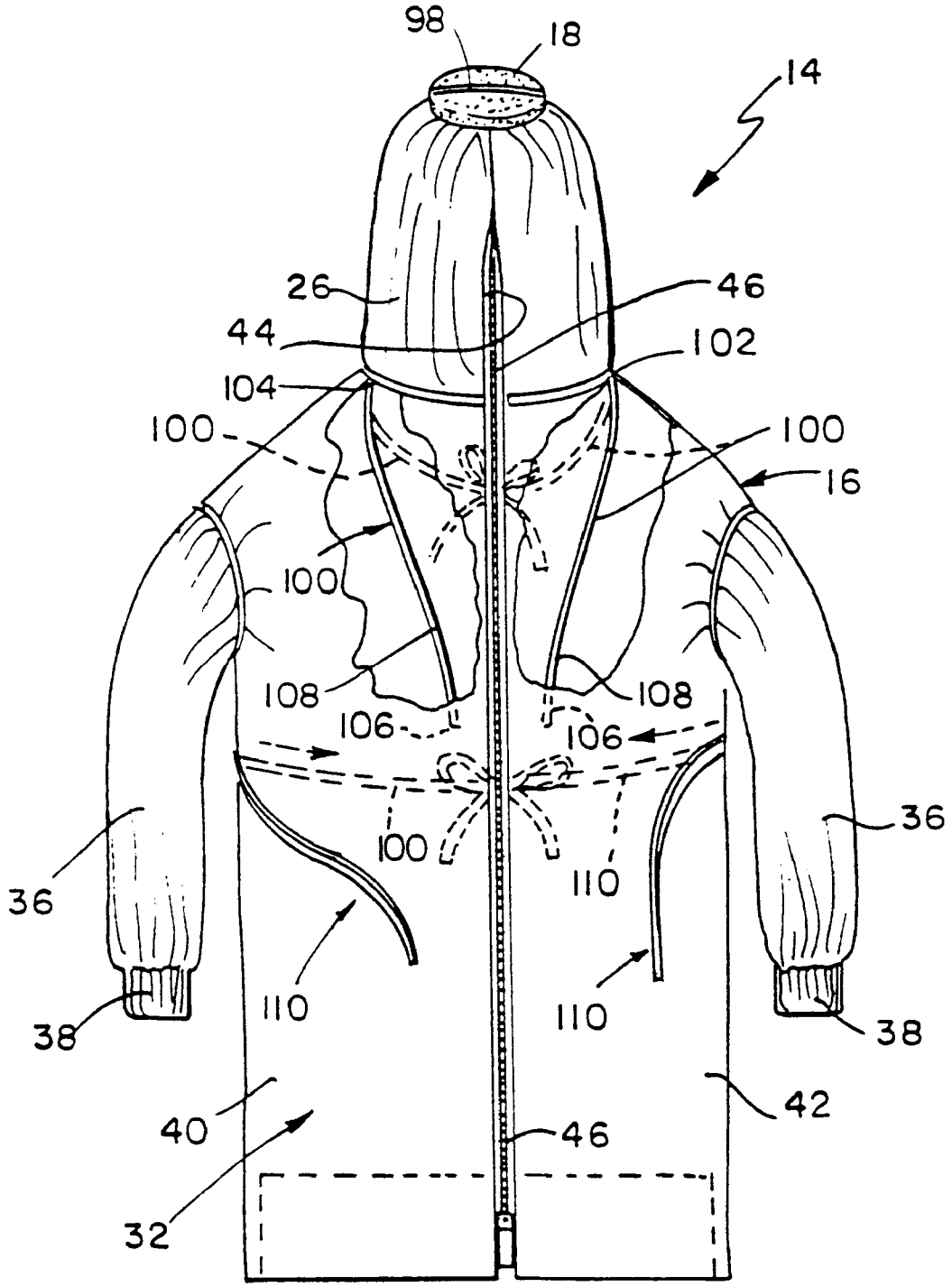
FIG. 9 is a back view of the head gear apparatus of FIG. 7 showing the zipper extending along the length of the back side, and showing in phantom, the waist ties tied together, the shoulder ties tied together, and the bottom edge of the front side in the fan-folded position.
Figure 10:
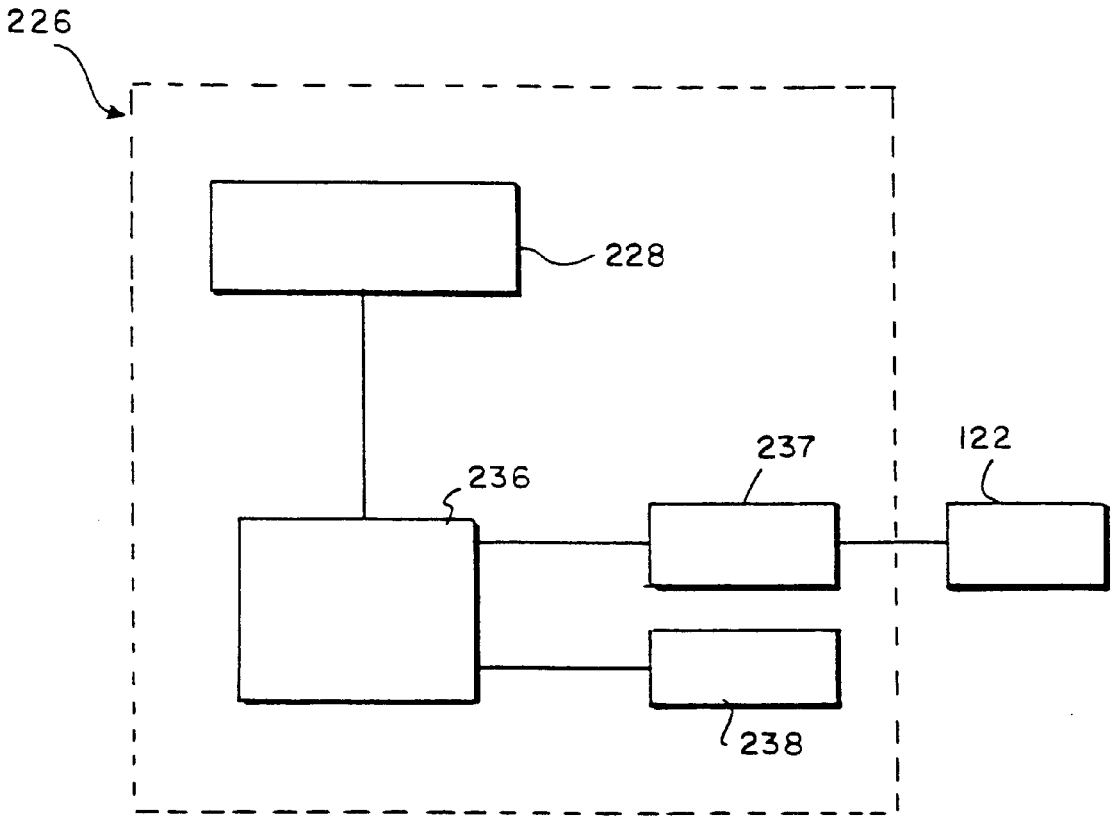
FIG. 10 is a diagrammatic view of a voltage converter assembly that is suitable for use with the head gear apparatus of the present invention, showing the converter assembly including a battery providing a low voltage input to a voltage converter, the voltage converter providing a high voltage output to the fan, and also showing a low voltage alarm in communication with the voltage converter.

Referring now to FIG. 9, back side 32 of fabric portion 16 includes a first panel 40 and a second panel 42. Head portion 26 includes a slit 44 formed adjacent to an intersection of first and second panels 40, 42. First and second panels 40, 42 of back side 32 and slit 44 of head portion 26 are coupled together by a zipper 46 to enable head portion 26 and back side 32 to be expandable in width and promote donning of garment 14. While zipper 46 is illustrated and described, it is appreciated that a wide variety of fastening mechanisms may be used in accordance with the present disclosure to couple first and second panels 40, 42 together. In addition, while seams 34 are sewn, it is appreciated that sealed seams may be used in accordance with the present disclosure. It is also appreciated that garment 14 may be formed as a zipperless toga (not shown).

Figure 8:
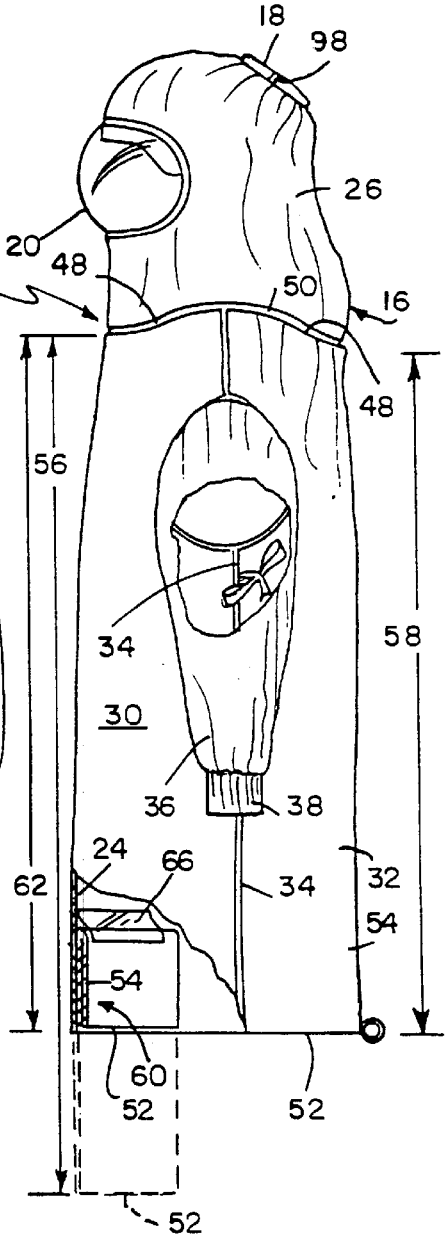
FIG. 8 is a side view of the head gear apparatus of FIG. 7 with portions broken away showing the garment having a back side coupled to the front side by a seam, one waist tie coupled to the seam, a zipper, and showing the bottom edge of the front side that is normally folded upon the middle portion and affixed in a fan-folded position so that the front side has a folded length that is generally equal to the normal length of back side.

As shown in FIG. 8, front and back sides 30, 32 of fabric portion 16 each include a top edge 48 coupled to head portion 26 by a top seam 50, an opposite bottom edge 52, and a middle portion 54 extending between top and bottom edges 48, 52. Front side 30 of fabric portion 16 has a normal pre-determined length as shown by line 56 that is greater than a normal pre-determined length as shown by line 58 of back side 32. Bottom edge 52 of front side 30 is folded upon middle portion 54 in a fan-folded position as shown by arrow 60 causing front side 30 to have a folded pre-determined length as shown by line 62 that is generally equal to the normal pre-determined length 58 of back side 32 of garment 16. Bottom edge 52 of front side 30 is held in fan-folded position 60 by an adhesive 66 adjacent inner surface 24 of fabric portion 16. Illustratively, adhesive 66 is one-sided tape although it is appreciated that a wide variety of adhesives or other fastening means may be used in accordance with the present invention to hold front side 30 in fan-folded position 60. Front side 30 may be adjusted to the normal length shown by line 56 by pulling bottom edge 52 away from top edge 48 to release adhesive 66 and permit front side 30 to unfold. Thus, a user of garment 14 may lengthen front side 30 of garment 14 if necessary to protect the user from splashing fluids and materials.

Referring now to FIG. 5, head portion 26 of garment 16 includes a rim 68 that defines a shield-receiving aperture 70 therethrough. Rim 68 is positioned to lie adjacent to front side 30 of garment 14 as shown in FIG. 7. In addition, head portion 26 includes a lip 72 that defines a filter-receiving aperture 74 therethrough. Illustratively, face shield 20 is coupled to rim 68. Face shield 20 includes a shield portion 78 and a border 80 extending about shield portion 78. Shield portion 78 is bulbous in shape and constructed of a generally transparent material that is impervious to fluids. Border 80 of face shield 20 is coupled to rim 68 of head portion 26 by an adhesive (not shown). It is appreciated, however, that a variety of attachment mechanisms may be used to couple face shield 20 to rim 68. Hook-and-loop type fasteners (not shown) are also coupled to border 80 to cooperate with hook-and-loop type fasteners 148 of shield mount 146. While face shield 20 is illustrated and described, it is appreciated that face shield 20 can be constructed in a wide variety of shapes and sizes and formed from a wide variety of materials.

Filter media 18 is coupled to lip 72 and covers filter-receiving aperture 74 to filter airborne particles. See FIG. 5. Filter media 18 is a laminate spun bond cover commercially available as 3M G150, from Minnesota Mining and Manufacturing Co., St. Paul, Minn., although it is appreciated that charcoal and a wide variety of other materials suitable for filtering airborne particles without significantly disrupting air flow may be used in accordance with the present disclosure. As best shown in FIG. 5, filter media 18 includes a front end 92 and an opposite back end 94 positioned to lie adjacent slit 44 in head portion 26. Front and back ends 92, 94 of filter media 18 are coupled to garment 14 by a seam (not shown). In addition, an elastic band 98 extends across filler media 18 spaced apart from front and back ends 92, 94. It is appreciated that elastic band 98 may extend along a portion of the seam adjacent back end 94 of filter media 18 and that filter media 18 may be coupled to garment 14 using a variety of attachment mechanisms such as ties, sewing gather, or the like in accordance with the present disclosure.

As shown in FIG. 9, garment 14 further includes shoulder ties 100 positioned to extend from inner surface 24 of fabric portion 16 at an intersection 102 between head portion 26 and front and back sides 30, 32. Shoulder ties 100 are configured to take up and secure excess material on a small framed user. Each shoulder tie 100 includes a first end 104 coupled to garment 14, an opposite second end 106, and a center portion 108 having a pre-determined tie length. The tie lengths are such that opposite ends 106 of ties 100 may be tied together to decrease the width of garment 14. Likewise, garment 14 includes waist ties 110 positioned to extend from outer surface 22 of fabric portion 16 along seam 34 between front and back sides 30, 32 adjacent arm portions 36. Waist ties 110 are formed similarly to shoulder ties 100 and are used in a similar manner to decrease the width of garment 16. It is appreciated that decreasing the width of the garment 14 can be achieved by a wide variety of gathering apparatuses.

As shown in FIG. 7 head gear apparatus 10 of the present invention further includes a voltage converter assembly 226. Converter assembly 226 includes a battery 230, an adapter 228 that is selectively coupled to battery 230, and a clip 232. Battery 230 is a commercially available 6-volt Nickel metal hydride battery. It is appreciated, however, that battery 230 may be selected from a wide variety of batteries having various voltages. Adapter 228 is sized to extend over battery 230 and houses a voltage converter 236 receives a low voltage input and converts it to a high voltage output 237. For example, voltage converter 236 is capable of converting six volts to twelve volts and thus increase the power to fan 122 without decreasing the life of battery 230. In addition, converter 236 allows the user to utilize a smaller, lighter-weight battery 230. Voltage converter 236 utilizes a Maxim Max773 12V high-efficiency, low IQ, Step-Up DC-DC Controller, commercially available from Maxim Integrated Products, Sunnyvale, CA. It is appreciated that a wide variety of voltage converters may be used in accordance with the present disclosure so long as controller converts voltage from battery 230 to a high voltage that is compatible with fan 122. Adaptor 230 further includes a low-voltage alarm 238, an on/off switch (not shown), and a voltage high/low switch (not shown). Clip 232 of voltage converter assembly 226 is coupled to adaptor 230. Clip 232 is configured to hold battery 230 on a waistband or pocket of a user.

In use, the user first places helmet 12 on head 28. At this time the user is free to adjust the relative positioning of fan housing 120 relative to front and back ends 128, 130 of shell 114. In addition, the user is free to adjust strap 214 by pivoting nape straps 220 on pivot pin 222 to achieve a desirable angle of strap 214, by rotating adjustment knob 224 to adjust the length of nape straps 220 until strap 214 fits securely on head 28, and by pivoting first portions 218 on fixation tab 217. Once helmet 12 is positioned on head 28, voltage converter assembly 226 may be fastened to power connector 192 and fastened to a belt buckle or waistband of the user by clip 232. To adjust the flow of air toward the user's face, the user must simply move frontal fixation tab 216, which in turn moves air flow deflector 126 into and out of passageway 118.

At this time the user unfolds garment 14 either alone or with assistance. The user then steps into garment, extends arms (not shown) through arm portions 36, and places head portion 26 over head 28. When garment 14 is formed with only head portion 26, the user simply places head portion 26 over head 28. In both cases, the user then raises the face shield 20 until border 80 engages location flange 150 on front end 128 of shell 114. Location flange 150 provides user with a mechanical stop which signals to the user that hook-and-loop type fasteners 148 that correspond with hook and loop-type fasteners (not shown) of face shield 20 are adjacent to border 80 of face shield 20. The user must simply press face shield 20 toward their face to attach face shield 20 onto helmet 12. To couple fan housing 120 and filter media 18 together, the user must simply pull filter media 18 over cover 176 of fan housing 120 until elastic band 98 extends over lip portion 178. Elastic band 98 grips lip portion 178 and holds filter media 18 in place.

The user may adjust the width of garment 14 by tying either opposing shoulder ties 100 or waist ties 110 together. In addition, the length of front side 30 of garment 14 may be lengthened. The user or an assistant must simply grasp bottom edge 52 of front side 30 of garment 14 and pull bottom edge 52 away from head portion 26. Pulling bottom edge 52 causes garment 16 to be pulled away from adhesive 66 that is coupled to inner surface 24 of garment 14. Thus, front side 30 moves from fan-folded position 60 to its normal pre-determined length 56.

Although the invention has been described in detail with reference to preferred embodiments, variations and modifications exist within the scope and spirit of the invention as described and defined in the following claims.

What is claimed is:

1. A head gear apparatus comprising:

a helmet including a shell configured to rest upon a head of a user and a fan housing movably coupled to the shell;

a fan positioned to lie within the fan housing; and a garment selectively coupled to the helmet, the garment including a face shield.

2. The apparatus of claim 1, wherein the shell includes a front end and a back end and the fan housing is movable between the front and back ends.

3. The apparatus of claim 2, wherein the shell is formed to include an aperture extending between the front and back ends and the fan housing is movable in the aperture between the front and back ends.

4. The apparatus of claim 3, wherein the aperture is defined by at least one guide track and the fan housing engages the at least one guide track.

5. The apparatus of claim 4, wherein the fan housing includes a floor portion formed to include at least one boss that rides along the at least one guide track.

6. The apparatus of claim 3, wherein the fan housing includes guides that extend through the aperture.

7. The apparatus of claim 3, wherein the shell includes an inner surface and an outer surface, the aperture extends between the inner and outer surfaces, and the helmet further includes a shield coupled to the inner surface of the shell adjacent to the aperture.

8. The apparatus of claim 2, wherein the shell includes an inner surface and an outer surface and the helmet further includes an inner panel spaced apart from the inner surface of the shell to define a passageway extending between the inner panel and the inner surface of the shell.

9. The apparatus of claim 8, wherein the passageway extends between the fan housing and the front end of the shell.

10. The apparatus of claim 1, wherein the shell includes a front end, a back end, and a shield mount adjacent to the front end that is formed for attachment with the garment.

11. The apparatus of claim 10, wherein the shield mount includes hook-and-loop type fasteners.

12. The apparatus of claim 10, wherein the shield mount includes a flange that is formed for engagement with the face shield.

13. The apparatus of claim 1, wherein the shell of the helmet defines a cavity and the fan housing is positioned to lie within the cavity.

14. The apparatus of claim 13, wherein the helmet includes an air duct that is coupled to the fan housing and defines a channel.

* * * * *